US006261118B1

(12) United States Patent
Daoud

(10) Patent No.: US 6,261,118 B1
(45) Date of Patent: Jul. 17, 2001

(54) INSULATION DISPLACEMENT CONNECTOR TERMINAL FOR A NETWORK INTERFACE DEVICE

(75) Inventor: Bassel Hage Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/107,329

(22) Filed: Jun. 30, 1998

(51) Int. Cl.[7] ..... H01R 4/24; H01R 4/26; H01R 11/20

(52) U.S. Cl. ..... 439/395

(58) Field of Search ..... 439/395, 387, 439/389, 391

(56) References Cited

U.S. PATENT DOCUMENTS 4,260,212 * 4/1981 Ritchie et al. ..... 439/395
4,413,872 * 11/1983 Rudy, Jr. et al. ..... 439/467
4,464,002 * 8/1984 Suzuki et al. ..... 439/397
5,004,433 4/1991 Daoud ..... 439/502
5,122,078 * 6/1992 Davis et al. ..... 439/405
5,683,266 * 11/1997 Guidi et al. ..... 439/395

FOREIGN PATENT DOCUMENTS

2115236 * 9/1983 (GB) .

* cited by examiner

*Primary Examiner*—Brian Sircus
*Assistant Examiner*—Michael C. Zarroli

(57) ABSTRACT

A network interface device includes a plug section pivotally attached to a jack section. The plug section includes a pair of terminals which form a portion of an insulation displacement connector. The upper end of each terminal has a pair of tines to which a wire may be connected. The terminals are installed into the plug section in the same direction as the direction of the downward forces applied to the tines of the terminals when connecting a wire thereto. The downward forces are borne by a stop shoulder on each terminal which engages an abutment on the plug section. This prevents the terminals from being inadvertently dislodged from the surrounding plug section. Thus, the terminals will remain properly positioned within the plug section when wires are forced onto the terminals.

17 Claims, 5 Drawing Sheets

INSULATION DISPLACEMENT CONNECTOR TERMINAL FOR A NETWORK INTERFACE DEVICE

BACKGROUND OF THE INVENTION

1. Field of the Invention

The present invention relates to a terminal of an insulation displacement connector, and more particularly, to a terminal utilized in a network interface device located between the telephone company network and the customer's equipment 2. Description of the Background Art Insulation displacement connectors are known in the art for interconnecting a wire to a terminal of a network interface device without first manually stripping the insulation from the wire to expose the conductor. For example, Applicant's prior U.S. Pat. No. 5,004,433 shows an insulation displacement connector having a terminal housed within a protective cap. A wire is first inserted through a hole in the cap. The cap is then displaced downwardly so that the wire is forced between a pair of blades on the upper part of the terminal. The blades cut through the insulation surrounding the conductor, and the wire is secured between a pair of tines of the terminal.

Typically the terminal of an insulation displacement connector is installed into the housing by pressing the terminal upwardly through a slot in the housing, with the upper end of the terminal having the tines passing through the slot first In other words, the direction of insertion of the terminal into the housing is opposite to the direction of the forces applied to the terminal during normal use of the connector.

The downward force necessary to force the wire between the blades and tines on an insulation displacement connector is quite large. -As a result the downward force applied to the terminal tends to force the terminal downwardly out of its surrounding housing. Once the terminal is no longer properly positioned within the housing, a wire will not be able to pass between the blades and be secured to the tines. Thus, the connector becomes no longer useful.

There is a need in the art for a terminal which can be installed into a housing in the same direction as the direction of the forces applied to the terminal during normal use of the insulation displacement connector, so that the terminal will remain properly positioned within the housing when a wire is forced onto the terminal.

SUMMARY OF THE INVENTION

The present invention fulfills the aforementioned need in the art by providing a terminal for an insulation displacement connector which prevents undesired withdrawal of the terminal once it is installed. The terminal includes an upper section which forms a portion of the insulation displacement connector, a lower section having a contact member, and a central section having a plurality of outwardly extending barbs. The terminal is installed into a plug section in the same direction as the direction of the downward forces applied to the upper section of the terminal when connecting a wire thereto. These downward forces are carried by a stop shoulder on the terminal which engages an abutment on the plug section. Thus, the terminal will remain fixed within the plug section when a wire is forced onto the terminal. The barbs are configured to prevent upward forces which may be applied to the terminal from pulling the terminal back out of the plug section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
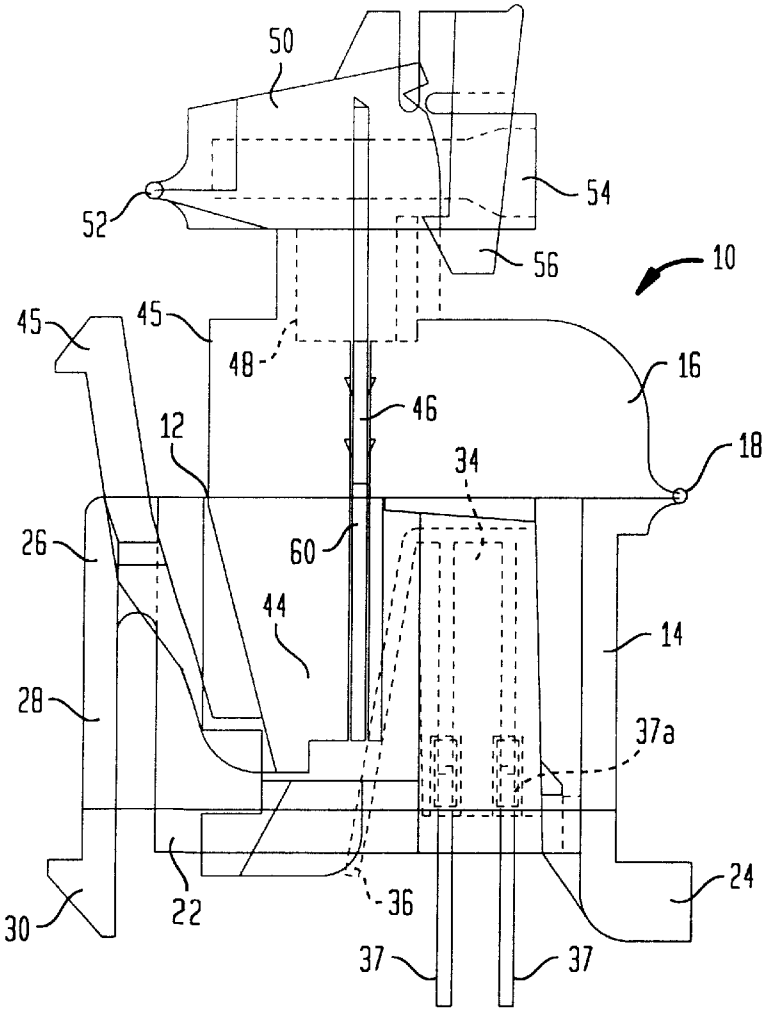
FIG. 1 is a side view of a network interface device having a terminal according to the present invention therein, with the network interface device in a closed position.
Figure 3:
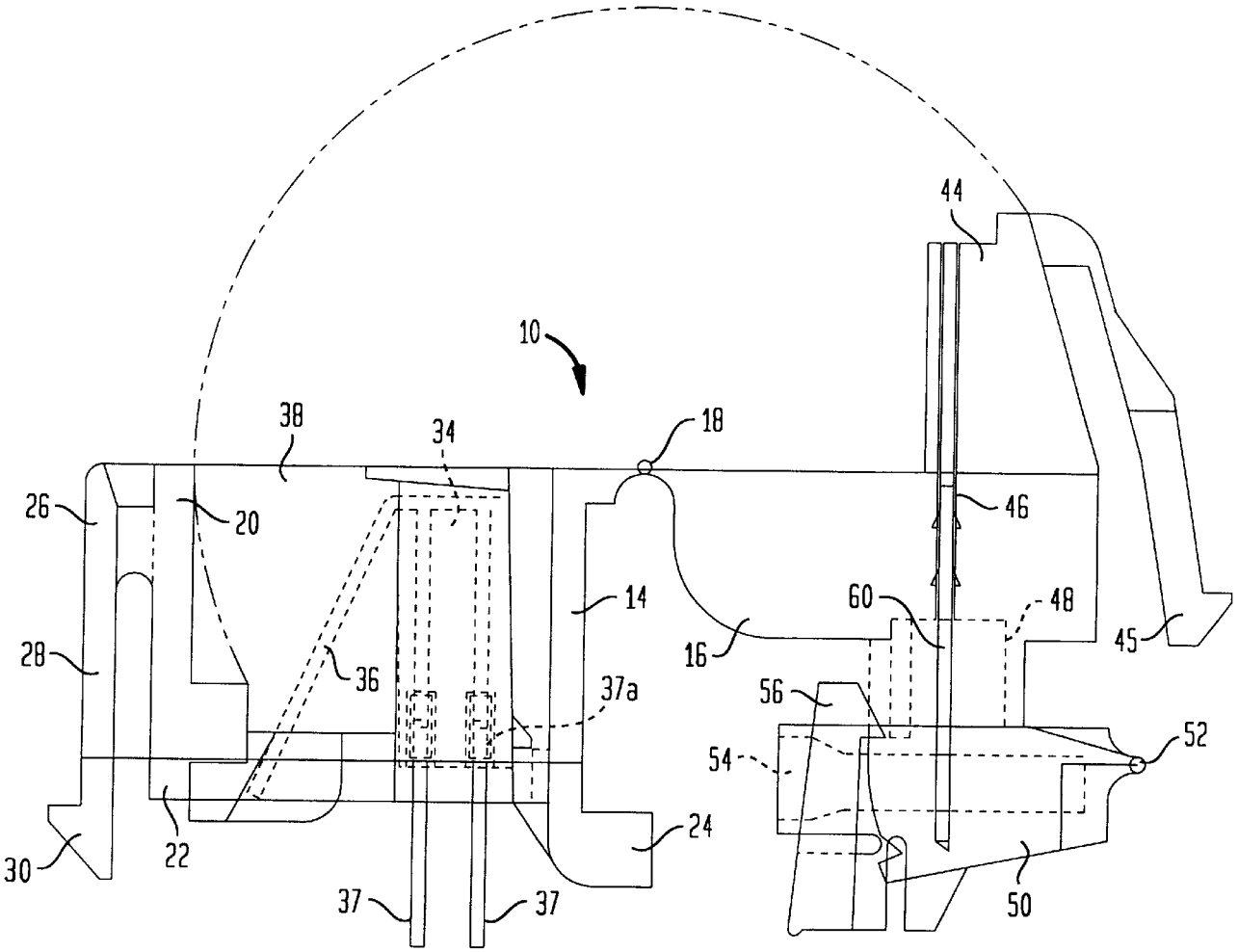
FIG. 3 is a side view of the network interface device in a partially open position.
Figure 4:
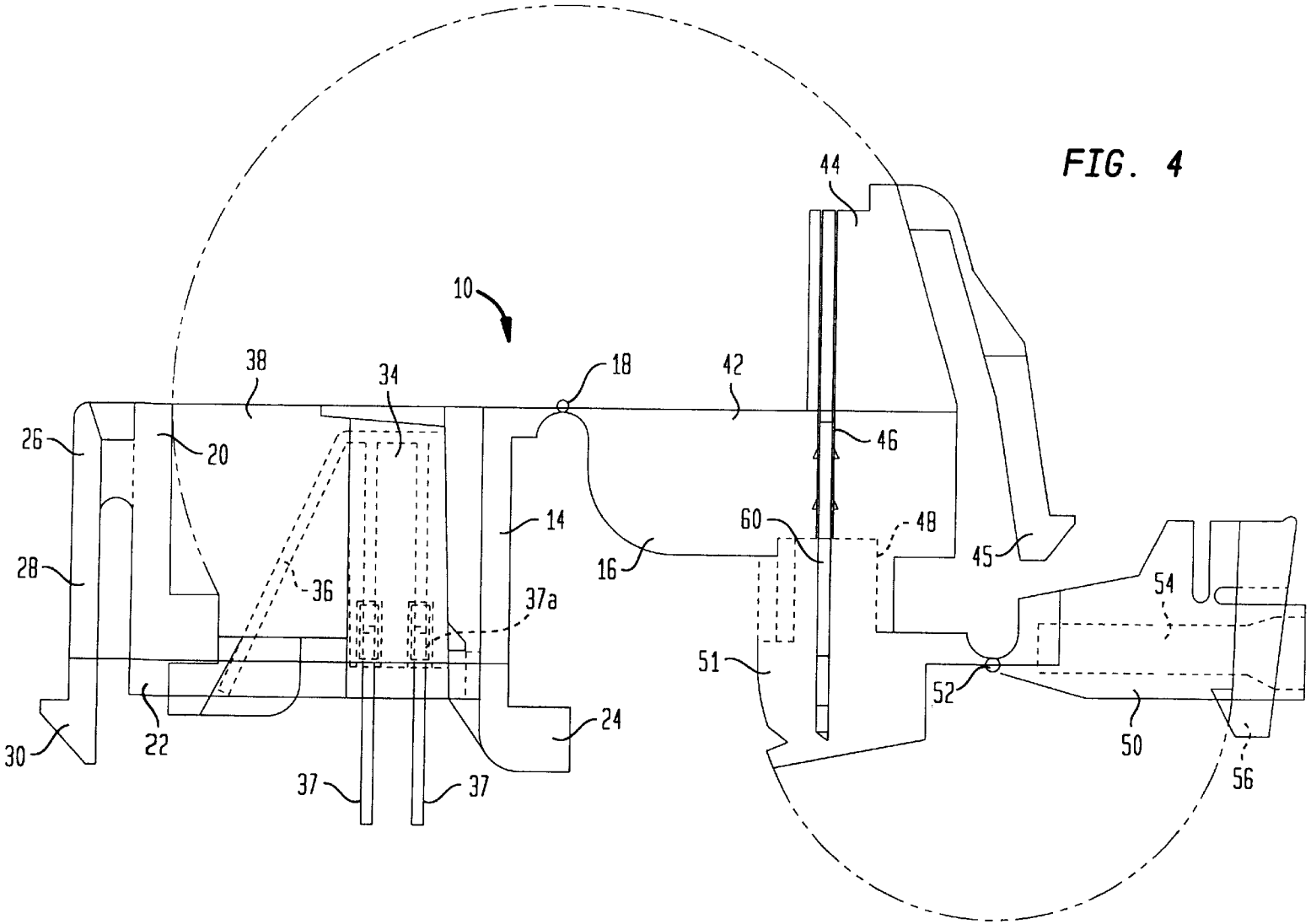
FIG. 4 is a side view of the network interface device in a fully open position.
Figure 5:
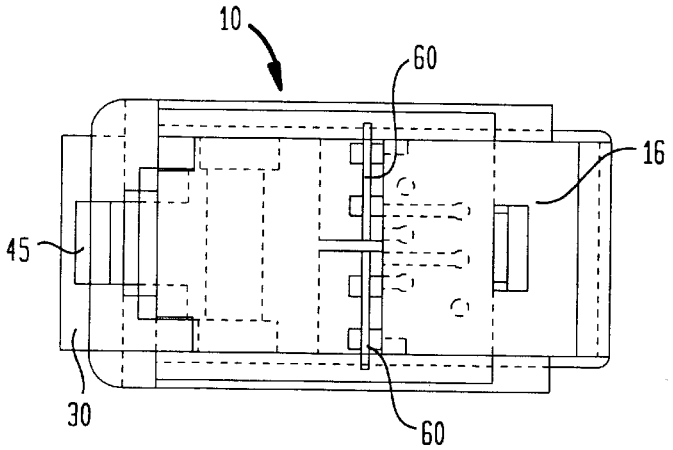
FIG. 5 is a top view of the network interface device in the closed position of FIG. 1.
Figure 6:
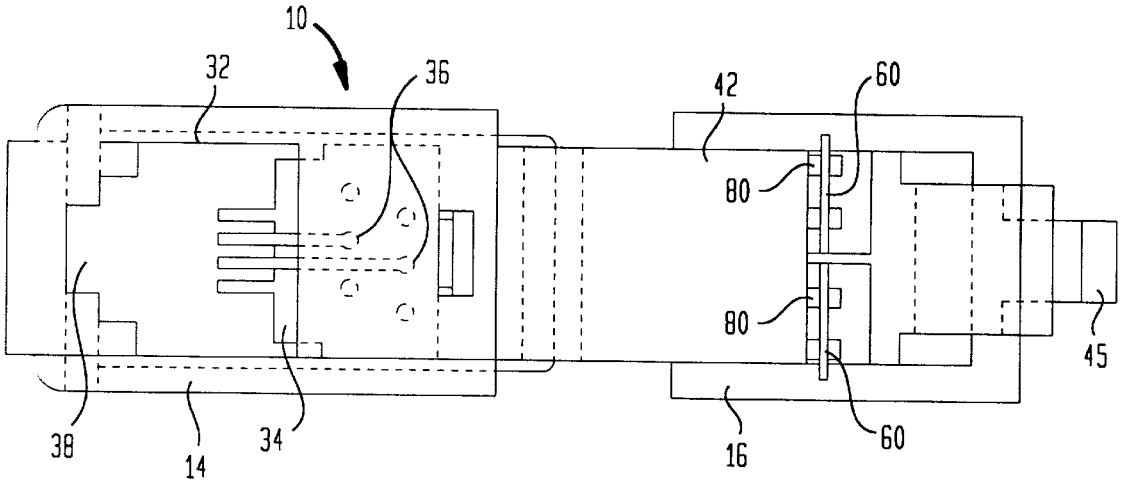
FIG. 6 is a top view of the network interface device in the partially open position of FIG. 3.

Referring in detail to the drawings, and with particular reference to FIG. 1, a network interface device 10 is shown. The network interface device 10 includes an interface device housing 12 having a jack section 14 and a plug section 16 pivotally conected to the jack section 14 by a living hinge 18. The jack section 14 and the plug section 16 are prefereably formed as a one-piece unit from an insulative plastic material, such as polyproplyene.

The jack section 14 has an essentially block-like main body portion 20. The lower portion of the main body portion 20 is formed as a rectangular base 22. The rectangular base 22 is receivable in a correspondingly shaped aperture in, for example, a chassis of a network interface enclosure (not shown).

The base 22 includes a lip 24 extending laterally away from one side of the main body portion 20. A latch 26 is located on the side of the main body portion 20 opposite to the lip 24. The latch 26 includes a cantilevered arm 28 extending downwardly from the upper portion of the main body portion 20. The cantilevered arm 28 terminates in a hook 30 directed outwardly from the main body portion 20. The lip 24 and the latch 26 together form a mechanism for retaining the jack section 14 within the aperture of the network interface enclosure.

Mounting of the jack section 14 in the aperture is accomplished by first inserting the base 22 into the aperture so that the lip 24 is beneath an underside of the chassis, and then rotating the jack section 14 so that the hook 30 of the latch 26 is secured under the other side of the aperture. The jack section 14 may thereafter be removed by pressing the cantilevered arm 28 of the latch 26 toward the main body portion 20 of the jack section 14 so that the hook 30 becomes disenaged from the undersurface of the chassis. The jack section 14 may then be rotated to disengage the lip 24, and then removed.

The upper surface of the main body portion 20 includes an essentially rectangular aperture 32 therein which extends downwardly into the main body portion 20. Located at one side of the aperture 32 is an insert 34, commonly known as a 645-type insert, which typically contains two or four spring wires 36 extending therefrom. In the present embodiment, two spring wires 36 are shown. The spring wires 36 form contact points for the plug section 16 which will be described in detail later.

A pair of wires 37 extend from one end of the spring wires 36, as shown in FIG. 1. The wires 37 are attached to the spring wires 36 by suitable connectors 37*a*, such as solderless crimped connectors. The aperture 32 having the insert 34 at one side thereof forms a jack 38 similar to a conventional telephone wall jack.

The plug section 16 has a main body portion 42 having a plug 44 extending from a lower side thereof. The plug section 16 is pivotal about the living hinge 18 from an open position where the plug 44 is out of, and spaced from, the jack 38, to a closed position where the plug 44 is received within the jack 38. A latch 45 is used to fasten the plug section 16 in the closed position. A terminal-receiving slot 46 passes vertically through the main body portion 42 and the plug 44.

An upper portion of the plug section 16 includes an aperture 48 into which a cap body 51 is fixedly located. A cap member 50 is pivotally attached to the cap body 51 by a living hinge 52. The cap member 50 includes a pair of wire-receiving passages 54 therein. A latch 56 is provided on the cap member for latching the cap member 50 in a closed position to the cap body 51. A more complete disclosure of the cap member 50 and the cap body 51 can be found in Applicant's application No. 09/107,674, now U.S. Pat. No. 5,971,795 entitled "Multiple Level Network Interface Device", the entire contents of which are hereby incorporated by reference.

Figure 2:
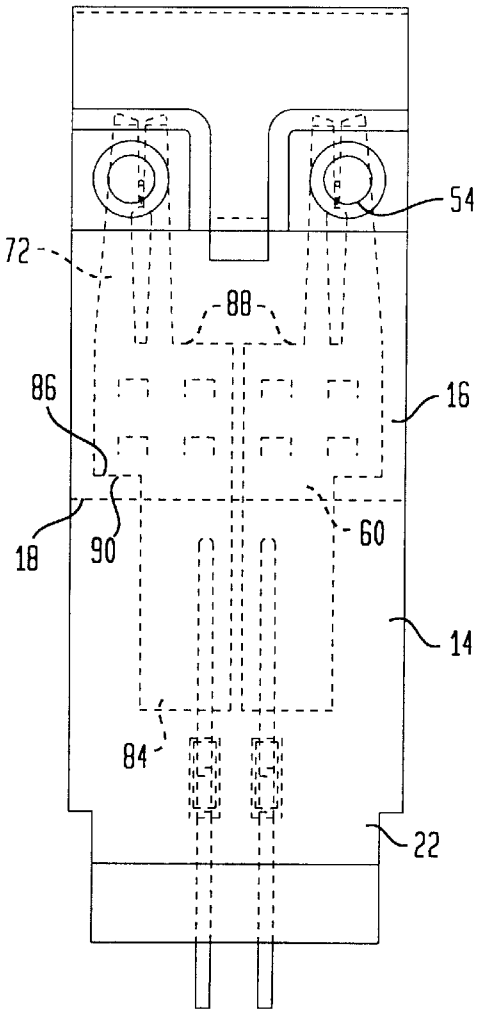
FIG. 2 is an end view of the network interface device shown in FIG. 1.

A pair of terminals 60 pass through the main body portion 42 and the plug 44. When the plug section 16 is pivoted to the closed position where the plug 44 is located within the jack 38, the terminals 60 located in the plug section 16 make contact with respective ones of the spring wires 36 in the jack 38. The terminals 60, shown in FIG. 2, are identical, except that one of the terminals has been flipped 180° such that the terminals are symmetric. Also, as shown in FIG. 1, both of the terminals 60 are located in the same vertical plane extending into the page.

Figure 7:
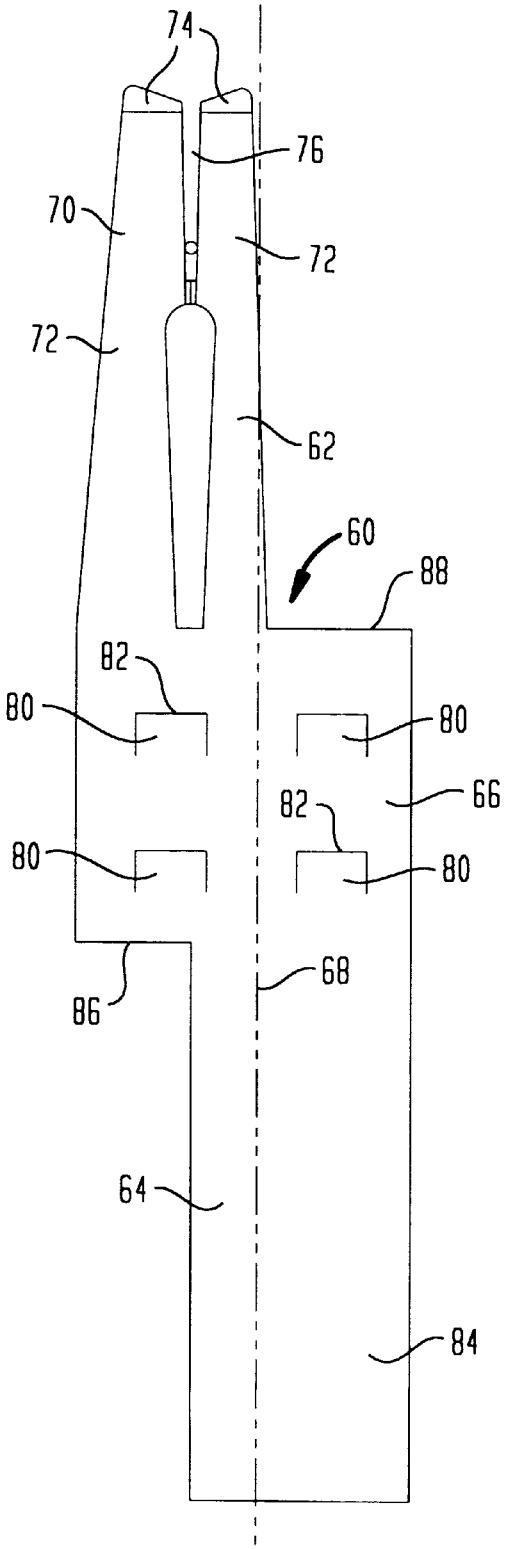
FIG. 7 is a front view of the terminal of the present invention.
Figure 8:
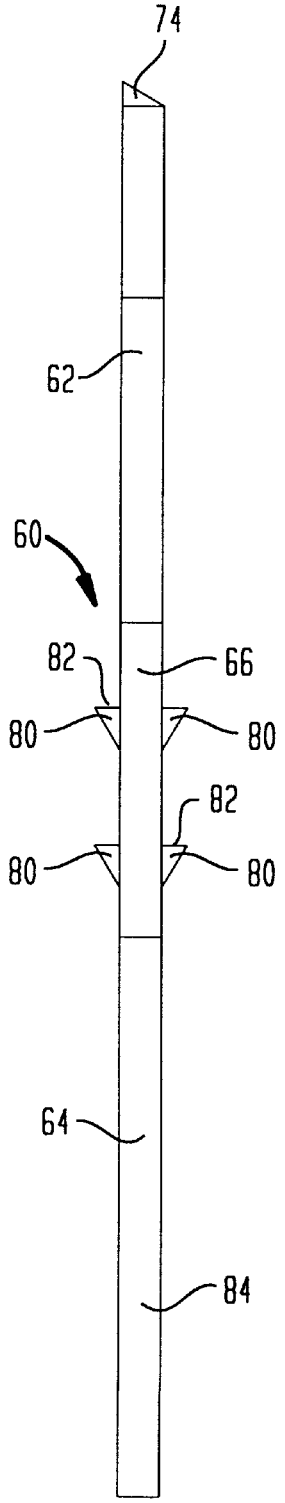
FIG. 8 is a side view of the terminal of FIG. 7.

Referring now to FIGS. 7 and 8, each of the terminals 60 includes an upper section 62, a lower section 64, and a central section 66 dividing the upper section 62 from the lower section 64. Each terminal 60 has a longitudinal axis 68 extending in a direction centrally along the major length of the terminal 60. The terminals 60 may be formed of phosphorbronze or other conductive materials.

The upper section 62 of each terminal 60 includes an insulation displacement portion 70 for connection to a wire (not shown). The wire includes a metallic conductor and an insulation jacket surrounding the metallic conductor. The insulation displacement portion 70 includes a pair of tines 72 having inwardly directed cutting edges 74. The tines 72 are separated by a gap 76 sized to accomodate a particular gage conductor therein, such that the conductor is wedged between the tines 72 and in electrical contact with the tines 72.

The central section 66 of each terminal 60 is substantially square, as shown in FIG. 7, although other shapes may be used. A plurality of barbs 80 extend outwardly of the plane of the central section 66. The barbs 80 extend from each side of the central section 66, as shown in FIG. 8. In the illustrated embodiment, four barbs 80 are utilized. Two of the barbs 80 extend from one side of the central section 66, and the other two barbs 80 extend from the other side of the central section 66. The two barbs 80 extending from each side of the central section 66 may be aligned parallel to the longitudinal axis 68 of the terminal 60, aligned across the width of the terminal perpendicular to the longitudinal axis 68, or may be arranged diagonally. Further, more or fewer barbs 80 may be uteezed as necessary.

The barbs 80 terminate in a sharp point 82, and are preferably formed as partially cut-away portions of the central section 66 which have been bent about a lateral line and out of the plane of the terminal 60. The points 82 of the barbs 80 are directed toward the upper section 62. The barbs 80 are thus arranged to allow insertion of the terminal 60 in one direction, while preventing undesired withdrawal of the terminal 60 once the terminal 60 is installed in the plug section 16.

The lower section 64 of each terminal 60 includes a contact portion 84. The lower section 64 extends laterally across approximately two-thirds of the width of the lower side of the central section 66. The remaining one-third of the lower side of the central section forms a stop shoulder 86. The stop shoulder 86 is aligned with the insulation displacement portion 70. The lower section 64 is laterally offset from the upper section 62, as shown in FIG. 7.

The upper section 62 extends laterally across approximately one-half of the width of the upper side of the central section 66. The remaining one-half of the upper side of the central section 66 forms an insertion shoulder 88. The insertion shoulder 88 is aligned with the contact portion 84.

The terminals 66 are installed within the slot 46 in the plug section 16 preferably using an ultrasonic insertion tool, although any mechanical forcing tool may be utilized. The ultrasonic tool provides an oscillating force at a very high frequency and at a very small amplitude. The lower section 64 of the terminal 60 is first inserted into the slot 46 in a downward direction as viewed in FIG. 1. The insertion tool engages the insertion shoulder 88 and presses the central section having the barbs 80 thereon into the slot 46. The insertion shoulder 88 allows the terminal 60 to be inserted into the slot 46 without contacting the sharp tines 72. Thus, damage to the tines 72 is prevented.

As the barbs move through the slot 46, the plastic material forming the slot temporarily melts ahead of the barbs 80, and solidifies behind the barbs 80, due to the ultrasonic vibrations of the insertion tool. The points 82 of the barbs 88 therefore become embedded into the main body portion 42. The barbs 80 securely fix the terminals 60 to the plug section 16.

Because of the angled orientation of the barbs 80, the terminal 60 may be easily inserted into the slot 46. However, removal of the terminal in the opposite direction is very difficult because removal forces only serve to more deeply embed the points 82 of the barbs 80 into the surrounding main body portion 42.

The central section 66 is inserted into the slot 46 until the stop shoulder 86 engages an abutment 90 provided within the slot 46. When the terminal 60 is installed within the slot 46 of the plug section 16, one side of the contact portion 84 is exposed to allow contact between the spring wires 36 and the contact portion 84 when in a closed position.

In use, a pair of wires (not shown) are passed through the wire-receiving passages 54 in the cap member 50. The cap member 50 is pivoted about the hinge 52 to a closed position and the latch 56 is engaged. As the cap member 50 is pivoted to the closed position, the wires pass between the tines 72 of the terminals 60. The wires contact the cutting edges 74, which pierce through the wire's insulation, exposing the wire's metallic core. The wire's metallic core is wedged into the gap 76 between the tines 72, thereby establishing electrical contact between the wires and the terminals-60.

The plug section 16 having the terminals 60 located therein is pivoted to a closed position. When the plug 16 is located within the jack 38 in the closed postion, the contact portion 84 contacts a respective spring wire 36 of the insert 34, as shown in FIG. 1, thereby establishing electrical contact between the wires 37 and the terminals 60.

When both the cap member 50 and the plug section 16 are in the closed positions, an electrical conection is established between the wires (not shown) in the cap member 50 and the wires 37 extending from the insert 34. In the preferred embodiment, this electrical connection connects the telephone company network to a customer's equipment Because the terminal 60 of the present invention is configured, as set forth above, and installed into the plug section 16 in the same direction as the direction of the downward forces applied to the tines 72 of the terminal 60 when connecting a wire thereto, the downward forces are borne by the stop shoulder 86 and the abuttment 90, which prevents the terminal 60 from being inadvertently dislodged from the surrounding main body portion 42. Thus, the terminal 60 will remain properly positioned within the plug section 16 when a wire is forced onto the terminal 60.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A terminal for an insulation displacement connector comprising:

an upper section having a pair of spaced-apart tines;

a lower section forming a contact portion;

a central section interconnecting said upper section to said lower section, said central section having a width and a thickness, said upper section, said lower section, and said central section all lying within a same flat plane defined by said thickness of said central section; and a plurality of barbs extending outwardly from opposite faces of said central section and out of said plane, wherein said upper section is laterally offset from said lower section with respect to a longitudinal axis extending centrally through said central section along a length of said terminal.

2. The terminal according to claim 1, wherein each of said barbs terminates in a point directed toward said upper section.

3. The terminal according to claim 1, wherein said barbs comprise cut-away portion of said central section which are bent outwardly of said plane.

4. The terminal according to claim 1, wherein said lower section extends laterally across less than a full width of a lower side of said central section.

5. The terminal according to claim 4, wherein said lower section extends laterally across approximately two-thirds of the width of said lower side of said central section.

6. The terminal according to claim 4, wherein a remaining portion of said lower side of said central section forms a stop shoulder.

7. The terminal according to claim 1, wherein said upper section extends laterally across less than a full width of an upper side of said central section.

8. The terminal according to claim 7, wherein said upper section extends laterally across approximately one-half of said full width of said upper side of said central section.

9. The terminal according to claim 7, wherein a remaining portion of said upper side of said central section forms an insertion shoulder.

10. The terminal according to claim 1, wherein said lower section extends laterally across approximately two-thirds of a width of said lower side of said central section, with a remaining portion of said lower side comprising a stop shoulder, and wherein said upper section extends laterally across approximately one-half of a width of said upper side of said central section, with a remaining portion of said tipper side comprising an insertion shoulder.

11. The terminal according to claim 10, each of said barbs terminating in a point directed toward said upper section.

12. A method of producing an insulation displacement connector for a network interface device comprising the following steps:

providing a terminal having an upper section with a pair of spaced-apart tines, a lower section, and a central section interconnecting said upper section to said lower section, said central section having a width and a thickness, said upper section, said lower section, and said central section all lying within a same flat plane defined by said thickness of said central section, and a plurality of barbs extending outwardly from opposite faces of said central section and out of said plane;

providing a housing with a slot extending thereinto; and inserting said terminal into said slot such that said lower section is first inserted into said slot.

13. The method according to claim 12, further comprising the steps of:

providing said housing with an abutment extending into said slot;

providing said terminal with a stop shoulder; and wherein said step of inserting comprises pressing said terminal into said slot until said stop shoulder engages said abutment.

14. The method according to claim 12, wherein said step of inserting comprises pressing said terminal into said slot so that said barbs embed into said housing.

15. A terminal for an insulation displacement connector comprising:

an upper section having a pair of spaced-apart tines;

a lower section forming a contact portion;

a central section interconnecting said upper section to said lower section, said central section having a width and a thickness, said upper section, said lower section, and said central section all lying within a same flat plane defined by said thickness of said central section, said upper section being laterally offset from said lower section with respect to a longitudinal axis extending centrally through said central section along a length of said terminal;

at least one barb extending outwardly from a face of said central section and out of said plane; and a housing, said housing including a jack section and a plug section, said plug section being pivotally connected to said jack section by a hinge such that said plug section may be moved from a closed position where a portion of said plug section is located within said jack section, to an open position where said portion of said plug is located outside of said jack section, wherein said terminal is located with in said plug section and pivotal therewith.

16. The terminal according to claim 15, wherein said lower section extends laterally across less than a full width of a lower side of said central section, with a remaining portion of said lower side comprising a stop shoulder, and wherein said upper section extends laterally across approximately less than a full width of an upper side of said central section, with a remaining portion of said upper side comprising an insertion shoulder.

17. The terminal according to claim 15, further comprising a plurality of barbs extending outwardly from said face of said central section and out of said plane, each of said barbs terminating in a point directed toward said upper section.

* * * * *